US007751769B2

(12) United States Patent
Ishida et al.

(10) Patent No.: US 7,751,769 B2
(45) Date of Patent: Jul. 6, 2010

(54) FIXING DEVICE AND IMAGE FORMING APPARATUS EQUIPPED WITH THE SAME

(75) Inventors: Naoyuki Ishida, Osaka (JP); Akihiro Kondo, Osaka (JP)

(73) Assignee: Kyocera Mita Corporation (JP)

( * ) Notice: Subject to any disclaimer, the term of this patent is extended or adjusted under 35 U.S.C. 154(b) by 228 days.

(21) Appl. No.: 12/014,263

(22) Filed: Jan. 15, 2008

(65) Prior Publication Data

US 2008/0170894 A1 Jul. 17, 2008

(30) Foreign Application Priority Data

Jan. 17, 2007 (JP) ..... 2007-007690
Jan. 17, 2007 (JP) ..... 2007-007691

(51) Int. Cl.
*G03G 15/20* (2006.01)

(52) U.S. Cl. ..... 399/329

(58) Field of Classification Search ..... 399/320, 399/328, 329
See application file for complete search history.

(56) References Cited

U.S. PATENT DOCUMENTS 5,157,444 A * 10/1992 Mori et al. ..... 399/329
5,343,279 A * 8/1994 Nagata et al. ..... 399/329
7,522,870 B2 * 4/2009 Fujino ..... 399/329

FOREIGN PATENT DOCUMENTS

JP 2005-157172 6/2005

* cited by examiner

*Primary Examiner*—Sandra L Brase
(74) *Attorney, Agent, or Firm*—Gerald E. Hespos; Michael J. Porco

(57) ABSTRACT

A fixing device for image forming apparatus includes: a first nip member in a shape of an endless belt and a second nip member that rotates while pressed against the first nip member. A heat source heats at least one of the nip members. A pressure receiver receives pressure applied to the first nip member from the second nip member. A sliding contact has a contact surface that makes sliding contact with an inner surface of an axial end of the first nip member. A supporting mechanism supports the sliding contact to displace the contact surface thereof away from the pressure receiver as the first nip member moves away from the sliding contact along the axial direction. The displacement increases frictional forces between the contact surface and the inner surface of the first nip member, thus suppressing axial displacement of the first nip member from the sliding contact.

16 Claims, 9 Drawing Sheets

FIXING DEVICE AND IMAGE FORMING APPARATUS EQUIPPED WITH THE SAME

BACKGROUND OF THE INVENTION

1. Field of the Invention

The present invention relates to a fixing device used in an image forming apparatus, such as a copying machine, a printer, and a facsimile machine, and to an image forming apparatus equipped with the same.

2. Description of the Related Art

Generally, an electrophotographic image forming apparatus, such as a copying machine, is provided with a fixing device as means for applying heat and pressure onto a toner image formed on a sheet to fuse toner particles and fix them on the sheet. There is known a fixing device that includes a heating member in the shape of an endless belt heated by a heat source and a pressure member driven to rotate while being pressed against the heating member for driving the heating member to rotate. Both of the heating member and the pressure member function as nip members. Specifically, both of the members have portions which are pressed against each other to form a nip portion. When a sheet with a toner image transferred thereon enters into the nip portion, the heating member heats the toner image and the pressure member applies a pressure to the toner image, which fixes the toner image onto the sheet.

In the fixing device configured as above, the heating member is formed in a belt-like shape (including a film-like shape) and has a small thickness, which enables heating the heating member quickly to a toner fusible temperature. This shortens waiting time of the user after the turning-on of the power or resumption from the sleep mode of the image forming apparatus, and thereby enhances the convenience for the user. This also makes it possible to stop supplying power to the heat source when the image forming apparatus is not used or to set a temperature of the fixing device lower than before when it is not in use, thus making an advantage of saving power consumption of the image forming apparatus.

The heating member in the shape of an endless belt, however, possibly leans to one side from the center position in the axial direction orthogonal to the traveling direction of the belt or wobbles while it is running. Such leaning or wobbling of the heating member is attributed to various factors, and is chiefly caused by unevenness of the nip pressure in the axial line direction between the heating member and the pressure member, which is introduced by low parallelism between the axial line of the heating member and the axial line of the pressure member. Leaning to the axial direction or wobbling of the heating member causes wrinkles in a sheet, poor fixing, and jamming resulting from disturbed transportation of a sheet. Further, serious displacement or wobbling might break an end portion of the heating member.

In order to prevent such displacement or wobbling of the heating member (belt) in the fixing device, Patent Document 1 (JP-A-2005-157172) discloses a heating device including a belt-like rotating body, a guide member that guides the rotating body, a pressure member pressed against the rotating body, heating means for heating the rotating body, a flange that supports the rotating body on the both sides, and an end portion holder that supports the flange and has a portion on which a part of the flange strikes. The end portion holder determines the positions of the both ends of the rotating body via the flange, thereby preventing the rotating body from leaning to the axial direction (see Claim 1 and paragraph 0025 of Patent Document 1).

The flange seems to be effective for a certain degree of leaning or wobbling of the heating member. However, when a extremely large force biasing the heating member to the axial direction presses the heating member against the flange, the force may finally break the end portion of the heating member. In short, when a force pressing the heating member against the flange is greater than mechanical strength of the heating member, breakage of the heating member is not avoidable. Such breakage shortens the life of the fixing device.

An inconvenience as described above can also happen in another fixing device in which the heating member and the pressure member are reversed, that is, in a fixing device in which a second nip member in the shape of a roller pressed against a first nip member in the shape of an endless belt corresponds to the heating member heated by the heat source, and the first nip member corresponds to the pressure member.

SUMMARY OF THE INVENTION

In view of the problems in the prior art discussed above, an object of the invention is to provide a fixing device capable of preventing or effectively suppressing leaning to the axial direction or wobbling of a first nip member in the shape of an endless belt to ensuring stable fixing performance and preventing breakage of the first nip member to achieve a longer life, and to provide a long-life image forming apparatus free from poor fixing by employing the fixing device.

In order to achieve the above and other objects, a fixing device according to one aspect of the invention includes: a first nip member in a shape of an endless belt; a second nip member that rotates while being pressed against the first nip member to drive the first nip member in a direction orthogonal to a central axis of rotations and to form a nip portion between the first nip member and the second nip member, the nip portion allowing a sheet to enter therebetween; a heat source for heating at least one of the first nip member and the second nip member; a pressure receiving member provided so as to make contact with an inner surface of the first nip member to receive a pressure applied to the first nip member from the second nip member in the nip portion; a sliding contact member that has a sliding contact surface making sliding contact with an axial end portion of the first nip member, that is, an end portion in a direction parallel to a rotation central axis of the second nip member; and a supporting mechanism that supports the sliding contact member. The supporting mechanism supports the sliding contact member in such a manner that the sliding contact surface of the sliding contact member comes into contact with an inner surface of the axial end portion of the first nip member at a portion opposing the pressure receiving member, and displaces the sliding contact member so that the sliding contact surface of the sliding contact member moves away from the pressure receiving member as the first nip member moves away from the sliding contact member along the axial direction. The displacement of the sliding contact member increases a frictional force induced between the sliding contact surface and the inner surface of the axial end portion of the first nip member and a frictional force induced between the axial end portion and the pressure receiving member, thereby preventing or effectively suppressing displacement of the first nip member in a direction away from the sliding contact member.

DETAILED DESCRIPTION OF THE PREFERRED EMBODIMENTS

Hereinafter, preferred embodiments of the invention will be described with reference to the drawings. It should be appreciated that the configurations and locations of respective components described in the embodiments below are chosen for the purposes of the disclosure and not intended as a definition of the limits of the invention.

Figure 1:
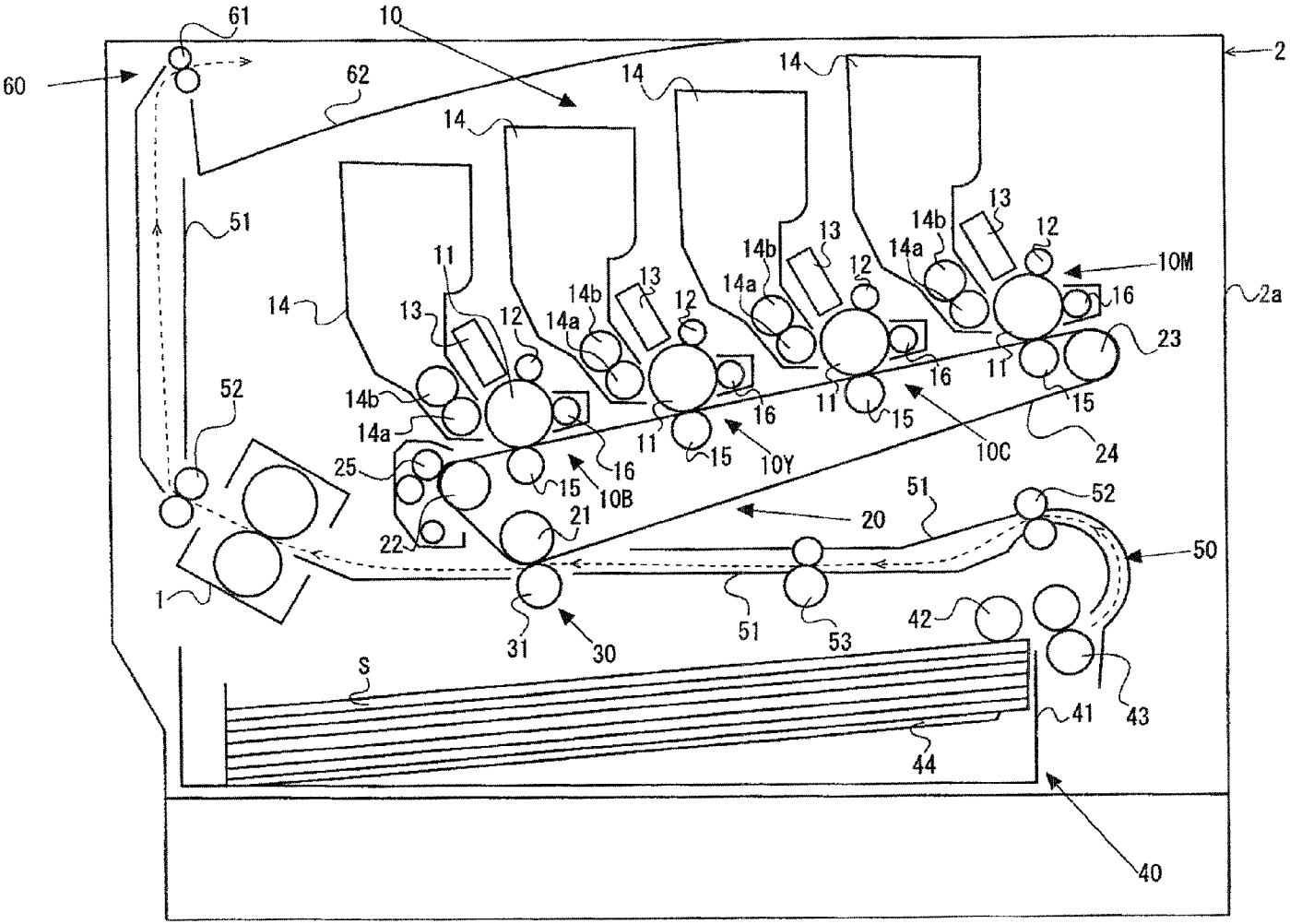
FIG. 1 is a view schematically showing the configuration of an image forming apparatus according to one embodiment of the invention.

FIG. 1 is a cross section schematically showing an electrophotographic full-color image forming apparatus 2 equipped with a fixing device 1 according to one embodiment of the invention.

As is shown in FIG. 1, the image forming apparatus 2 has a box-shaped case 2*a*, which accommodates therein an image forming portion 10, an intermediate transfer portion 20, a secondary transfer portion 30, a sheet feeding portion 40, a sheet transportation path 50, a fixing device 1, a discharge portion 60, and so forth.

The image forming portion 10 forms a toner image according to image data inputted into the image forming apparatus 2. The image forming portion 10 is provided at a position on the upper side in the interior of the image forming apparatus 2 and has four image forming units 10B, 10Y, 10C, and 10M: the image forming unit 10B for forming a black image, the image forming unit 10Y for forming a yellow image, the image forming unit 10C for forming a cyan image, and the image forming unit 10M for forming a magenta image. These units, which are aligned in this order from left to right on the sheet surface of FIG. 1, enables the image forming apparatus 2 to form a full-color image.

As is shown in FIG. 1, each of the image forming units 10B, 10Y, 10C, and 10M has a photoconductive drum 11 serving as an image carrier, a charging roller 12, an exposing device 13, a developing device 14, a primary transfer roller 15, a drum cleaning roller 16, and so forth.

The photoconductive drum 1 has an outer peripheral surface, on which an electrostatic latent image is formed. Further, toner particles T are supplied to the electrostatic latent image to form a toner image. The photoconductive drum 11 is positioned at the center of each image forming unit. The photoconductive drum 11 contains, for example, a drum made of aluminum, and a photoconductive layer made of positively charged OPC or amorphous silicon, the photoconductive layer formed on the outer peripheral surface of the drum. The photoconductive drum 11 is driven to rotate in a counterclockwise direction when viewed in front in FIG. 1 at a specific process speed by an unillustrated driving device.

The charging roller 12 is provided above the photoconductive drum 11 to charge the outer peripheral surface of the photoconductive drum 11 to a specific potential. For this charge, the charging roller 12 rotates in a clockwise direction when viewed in front in FIG. 1 at a specific process speed under application of a specific voltage.

The exposing device 13 irradiates light to the peripheral surface of the photoconductive drum 11 that is charged uniformly by the charging roller 12 to scan and expose the peripheral surface of the photoconductive drum 11 with light according to the image data inputted into the image forming apparatus 2, thus forming an electrostatic latent image on the peripheral surface of the photoconductive drum 11. Referring to FIG. 1, the exposing device 13 is provided at a position above the photoconductive drum 11 and on the left of the charging roller 12.

The developing device 14 supplies toner particles T onto the electrostatic latent image formed on the peripheral surface of the photoconductive drum 11 to form a toner image thereon. Referring to FIG. 1, the developing device 14 is provided on the left side of the photoconductive drum 11, having a developing roller 14*a* that opposes the photoconductive drum 11 with a specific spacing therebetween. The developing roller 14*a* rotates in a clockwise or counterclockwise direction when viewed in front in FIG. 1 at a specific process speed.

The developing device 14 stores therein a developing agent containing toner particles T and charges the toner particles T to a specific potential. Specifically, the developing device 14 in the image forming unit 10B stores therein a developing agent containing black toner particles T. The developing device 14 in the image forming unit 10Y stores therein a developing agent containing yellow toner particles T. The developing device 14 in the image forming unit 10C stores therein a developing agent containing cyan toner particles T. The developing device 14 in the image forming unit 10M stores therein a developing agent containing magenta toner particles T. each developing device 14 further has a toner supply roller 14*b* at a position diagonally above the developing roller 14*a*, which supplies an adequate amount of toner particles T (developing agent) to the developing roller 14*a* to form a thin layer of toner particles T on the peripheral surface of the developing roller 14*a*.

The primary transfer roller 15 transfers a toner image formed on the photoconductive drum 11 onto an intermediate transfer belt 24 stretched in the intermediate transfer portion 20. Specifically, the primary transfer roller 15, provided beneath the photoconductive drum 11, nips the endless intermediate transfer belt 24 described below with the photoconductive drum 11 to form a nip for primary transfer, while being driven by the photoconductive drum 11 and the intermediate transfer belt 24 to rotate in a clockwise direction when viewed in front in FIG. 1. To the primary transfer roller 15 is applied a specific voltage for transference of the toner image.

Referring to FIG. 1, the drum cleaning roller 16 is provided on the right side of the photoconductive drum 11 and removes and collects toner particles remaining on the surface of the photoconductive drum 11 after the primary transfer for appropriate formation of the next toner image. The drum cleaning roller 16 is formed in a cylindrical shape with a peripheral surface made of such a material as EPDM for example, and it is driven to rotate in a counterclockwise direction when viewed in front in FIG. 1 at a specific process speed.

The intermediate transfer portion 20 transfers a toner image formed on the photoconductive drum 11 onto a sheet S. The intermediate transfer portion 20 is provided almost at a center of the image forming apparatus 2, including a driving roller 21, two tension rollers 22 and 23, the intermediate transfer belt 24 stretched over these rollers 21, 22, and 23, and a belt cleaning device 25.

The driving roller 21 is provided below the image forming unit 10B, and receives a supply of a rotary driving force from an unillustrated motor to rotate the intermediate transfer belt 24. The tension rollers 22 and 23 are disposed in such a manner that portions of the intermediate transfer belt 24 nipped by the photoconductive drums 11 and the primary transfer rollers 15 in the respective image forming units 10B, 10Y, 10C, and 10M are on a straight line. Specifically, the tension roller 22 is provided on the left side of the photoconductive drum 11 in the image forming unit 10B at the leftmost position in FIG. 1 while the tension roller 23 is provided on the right side of the image forming unit 10M at the rightmost position in FIG. 1, and the both rollers rotate at their respective positions.

The intermediate transfer belt 24 is stretched over the driving roller 21, the tension rollers 22 and 23, and the respective primary transfer rollers 15, and driven in a clockwise direction when viewed in front in FIG. 1 by rotation of the driving roller 21. Since the intermediate transfer belt 24 passes through the nip formed between the photoconductive drum 11 and the primary transfer roller 15 as has been described, a toner image on the photoconductive drum 11 is primarily transferred onto the intermediate transfer belt 24 upon application of a transfer voltage on the primary transfer roller 15 at specific timing.

The belt cleaning device 25 cleans toner particles remaining on the surface of the intermediate transfer belt 24 after secondary transfer to remove and collect these toner particles. Referring to FIG. 1, it is provided on the left side of the driving roller 21 and the tension roller 22.

The secondary transfer portion 30 is chiefly formed of a secondary transfer roller 31 and the driving roller 21. The secondary transfer roller 31 secondarily transfers a toner image that has been primarily transferred onto the intermediate transfer belt 24 onto a sheet S, such as a sheet of paper. It is pressed against the intermediate transfer belt 24 at a portion in contact with the outer peripheral surface of the driving roller 21 at specific timing by an unillustrated contacting and spacing mechanism. When the secondary transfer roller 31 is pressed against the portion, a transfer voltage is applied to the secondary transfer roller 31 to transfer the toner image on the intermediate transfer belt 24 onto the sheet S.

The sheet feeding portion 40 feeds a sheet S e.g. copy paper, an OHP sheet, and label paper, toward the secondary transfer portion 30. The sheet feeding portion 40 includes a cassette 41, a pickup roller 42, and a double sheet feeding preventing roller pair 43. The cassette 41 is of a box shape with an open top surface to accommodates plural sheets S. Inside the cassette 41 is provided a placing plate 44 on which plural sheets S are placed. Referring to FIG. 1, the pickup roller 42 is provided at an upper right position of the cassette 41.

The sheet feeding portion 40 performs a sheet feeding operation as follows. The sheet feeding portion 40 has an unillustrated lifting mechanism, which lifts the placing plate 44 to contact the uppermost one among the sheets S placed on the placing plate 44 with the pickup roller 42. The pickup roller 42 is rotated to send out the sheet S in contact with the pickup roller 42 to the sheet transportation path 50 one at a time. The double sheet feeding preventing roller pair 43 is provided at a position in close proximity to the pickup roller 42 and downstream thereof in the sheet transportation direction, and each roller is rotated so as to prevent plural sheets S from being sent out in an overlapped state.

The sheet transportation path 50 is provided with plural guides 51, a transportation roller pair 52, a registration roller pair 53, and so forth, so as to transport a sheet S from the sheet feeding portion 40 to the discharge portion 60 via the secondary transfer portion 30 and the fixing device 1. The registration roller pair 53 is provided upstream of the secondary transfer portion 30 in the sheet transportation direction. It suspends a sheet S being transported and then feeds the sheet S to the secondary transfer portion 30 at specific timing and speed to allow the toner image to be transferred onto the sheet S at a suitable position in the secondary transfer portion 30.

In FIG. 1, the transportation path of sheets S is indicated by a broken line.

The fixing device 1 applies a pressure and heats to a toner image secondarily transferred onto a sheet S to fuse toner particles T forming the toner image, thus fixing the toner image onto the sheet S. This operation will be described below in detail.

The discharging portion 60 has a discharge port, a discharge roller pair 61 for discharging the sheet S from the discharge port, and a discharge tray 62 provided on the top surface of the image forming apparatus 2 for receiving the sheet S discharged from the discharge port, to discharge a sheet S bearing the image thereon from inside the image forming apparatus 2. The discharge tray 62 allows the Sheets S up to a certain number on which the images have been formed to be placed thereon.

An image forming operation by the image forming apparatus 2 as above will now be described.

Upon transmission of an image formation start signal, the photoconductive drum 11 is rotated at a specific process speed to be uniformly charged to the positive polarity by the charging roller 12. The exposing device 13 converts an image signal inputted therein to a light signal to scan and expose the charged photoconductive drum 11 with a laser beam, thus forming an electrostatic latent image on the photoconductive drum 11.

Meanwhile, to the developing device 14 is applied a developing bias of the same polarity as the charged polarity (positive polarity) of the photoconductive drum 11. The developing device 14 supplies toner particles T to the electrostatic latent image to turn the image visible as a toner image. The toner image is primarily transferred onto the rotating (moving) intermediate transfer belt 24 by the primary transfer roller 15 to which primary transfer bias (the polarity opposite to the polarity of the toner particles T (negative polarity)) is applied between the photoconductive drum 11 and the primary transfer roller 15.

For forming a color image, the image forming unit 10B primarily transfers a black toner image on the intermediate transfer belt 24 first in the same process as described above. The portion of the intermediate transfer belt 24 bearing the transferred black toner image moves to the next image forming unit 10Y. The image forming unit 10Y then superimposes a yellow toner image on the black toner image. Likewise, the image forming unit 10C superimposes a cyan toner image and the image forming portion 10M superimposes a magenta toner image on the transferred toner images. A full-color toner image is thus formed merely by primarily transferring toner images onto the intermediate transfer belt 24 and by rotating the intermediate transfer belt 24.

The toner images superimposed on the intermediate transfer belt 24 are secondarily transferred by the secondary transfer portion 30 onto a sheet S transported by the registration roller pair 53 at adjusted timing. The sheet S is transported to the fixing device 1 to fuse and fix the toner image thereon, and thereafter discharged from the discharge portion 60.

The structure of the fixing device 1 according to this embodiment of the invention will now be described in detail with reference to FIG. 2 through FIG. 4.

Figure 2:
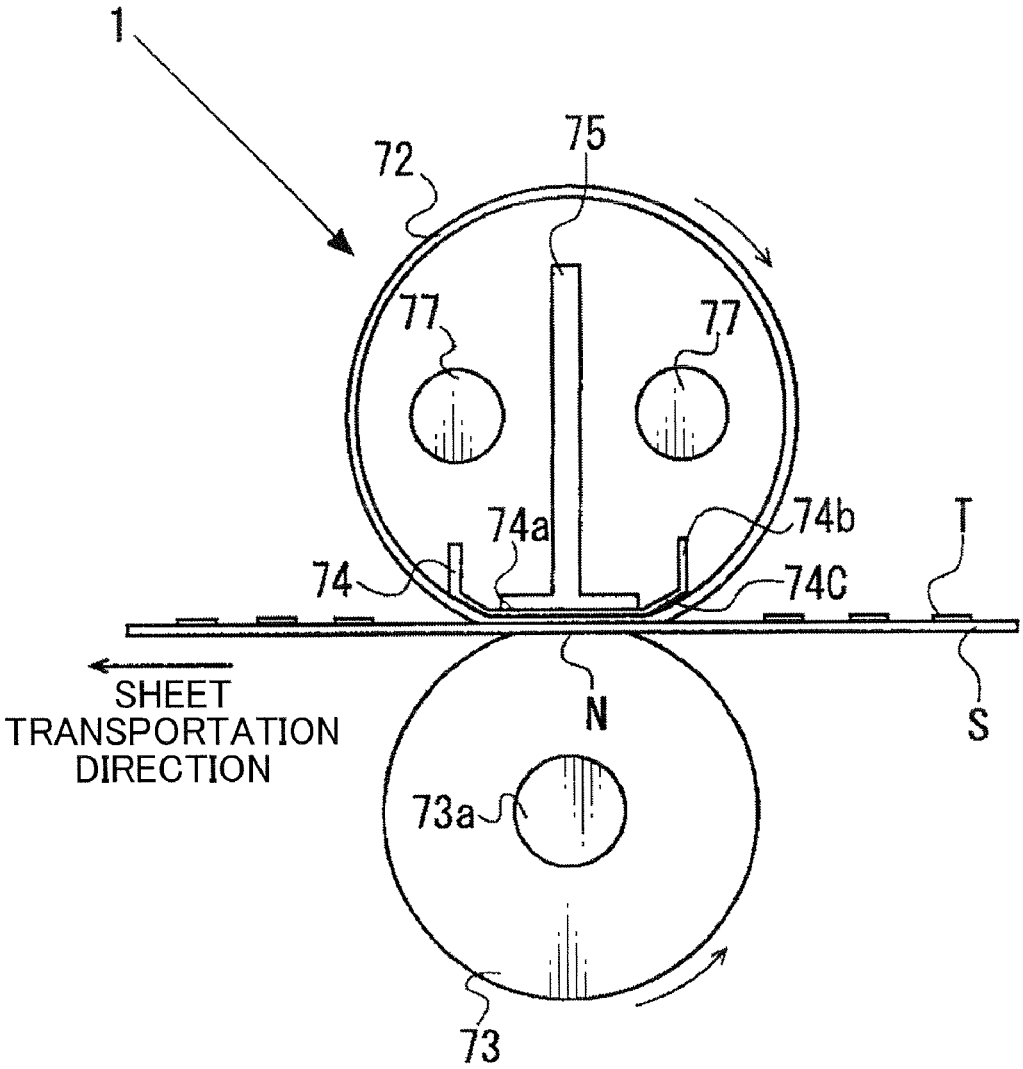
FIG. 2 is a side view of a fixing device provided in the image forming apparatus.

FIG. 2 is a sectional side view schematically showing the structure of the fixing device 1. The fixing device 1 includes a heating member 72 corresponding to the first nip member, heat sources 77, a pressure member 73 corresponding to a second nip member, a pressure receiving member 74, and optionally a reinforcing member 75. The heating member 72 and the pressure member 73 form a nip portion N therebetween, and fix toner particles T on a sheet S coming into and passing through the nip portion N.

The heating member 72 is heated by the heat sources 77. The heating member 72 is formed in a shape of an endless belt made of, for example, a thin metal film In this embodiment, it is formed in a cylindrical shape. The thickness of the heating member 72 is suitably, for example, of the order of 30 μm. It should be appreciated, but not limited to 30 μm. The thickness can be changed as needed according to a material of the heating member 72 and the thickness of a sheet S on which a toner image is fixed. For example, the thickness can be chosen as needed in a range from 20 to 100 μm.

Considering a heat capacity, strength, heat resistance, and wear resistance into account, it is possible to make the heating member 72 of SUS (stainless steel) for example. The heating member 72 according to this embodiment is made of stainless foil having a thickness of, for example, 30 μm. The material of the heating member 72, however, is not limited to metal, and it may be made of resin, for example, polyimide. Further, on the surface (peripheral surface) of the heating member 72 may be formed a mold-releasing layer having a mold-releasing property enhanced by fluorocarbon resin or the like. The mold-releasing layer is able to prevent formation of wrinkles in the sheet S because of lamination of the sheet S to the heating member 72 due to viscosity of the toner particles T fused and fixed on the sheet S which has passed through the nip portion N, or jamming of the sheet S in the fixing device 1.

The heating member 72 can have a diameter, for example, of the order of 30 mm, but may be a compact member having a diameter of, for example, 20 mm or smaller or conversely a large member having a diameter of 40 mm or larger. In short, the diameter of the heating member 72 can be set as needed to suit the size of the fixing device 1.

The width of the heating member 72, that is, the dimension of the heating member 72 in a direction orthogonal to the sheet transportation direction (a direction orthogonal to the sheet surface of FIG. 2) corresponds to the size of A4-sized paper in a portrait direction. The length, however, can be also set as needed to suit the size of the fixing device 1 and the size of a sheet S used in the image forming apparatus 2.

In this embodiment, the heat sources 77 are provided inside the heating member 72 and at both sides of the reinforcing member 75, extending along the axial direction of the heating member 72. These heat sources 77 heat the heating member 72 to a temperature high enough to fuse toner particles. As these heat sources 77 can be used a radiation type heat source such as a halogen lamp for example, but they are not limited to halogen lamps and may be known heat sources capable of heating the heating member 72. In addition, a single heat source 77 may be adopted.

In a case where halogen lamps are used as the heat sources 77 of this embodiment, They can output 1100 W in total while one lamp outputs 500 W and the other outputs 600 W, for example. The outputs of the two heat sources 77 may be different as described above or they may be the same. The output values are not limited to either 500 W or 600 W, and can be changed as needed to suit the specification of the fixing device 1.

In addition, the two heat sources 77 do not be required to operate at the same time. For example, they may be controlled in such a manner that the both operate when heating the heating member 72 quickly, for example, at the start-up of the image forming apparatus 2, while either one operates subsidiarily to maintain the temperature of the heating member 72 when fixing is performed continuously by the heating member 72 sufficiently heated. This control makes it possible to save power while keeping the temperature of the heating member 72 suitable.

The heat sources 77 as described above quickly heat the thinly-made heating member 72 to a temperature needed to fuse toner particles T of the order of 200° C.

The pressure member 73 has a roller shaft 73*a* and a roller main body provided therearound. The roller shaft 73*a* has opposite ends, which are rotatably supported on the case 2*a* or the like so that the roller main body is supported at a position where it is pressed against the heating member 72. The roller shaft 73*a* of the pressure member 73 is connected to an unillustrated driving mechanism, which includes a motor, a gear, and so forth to rotate the pressure member 73. This rotation drive the heating member 72 to rotate.

Specifically, the roller main body of the pressure member 73 is made of a rubber material such as silicon rubber, for example, and formed in the shape of a circular column. The roller main body is pressed against the heating member 72 to form the nip portion N between the self and the heating member 72. The heating member 72 heats a sheet S passing through the nip portion N and the pressure member 73 applies a pressure to the sheet S. This fuses and fixes toner particles T mounted on the sheet S onto the sheet S.

Figure 3:
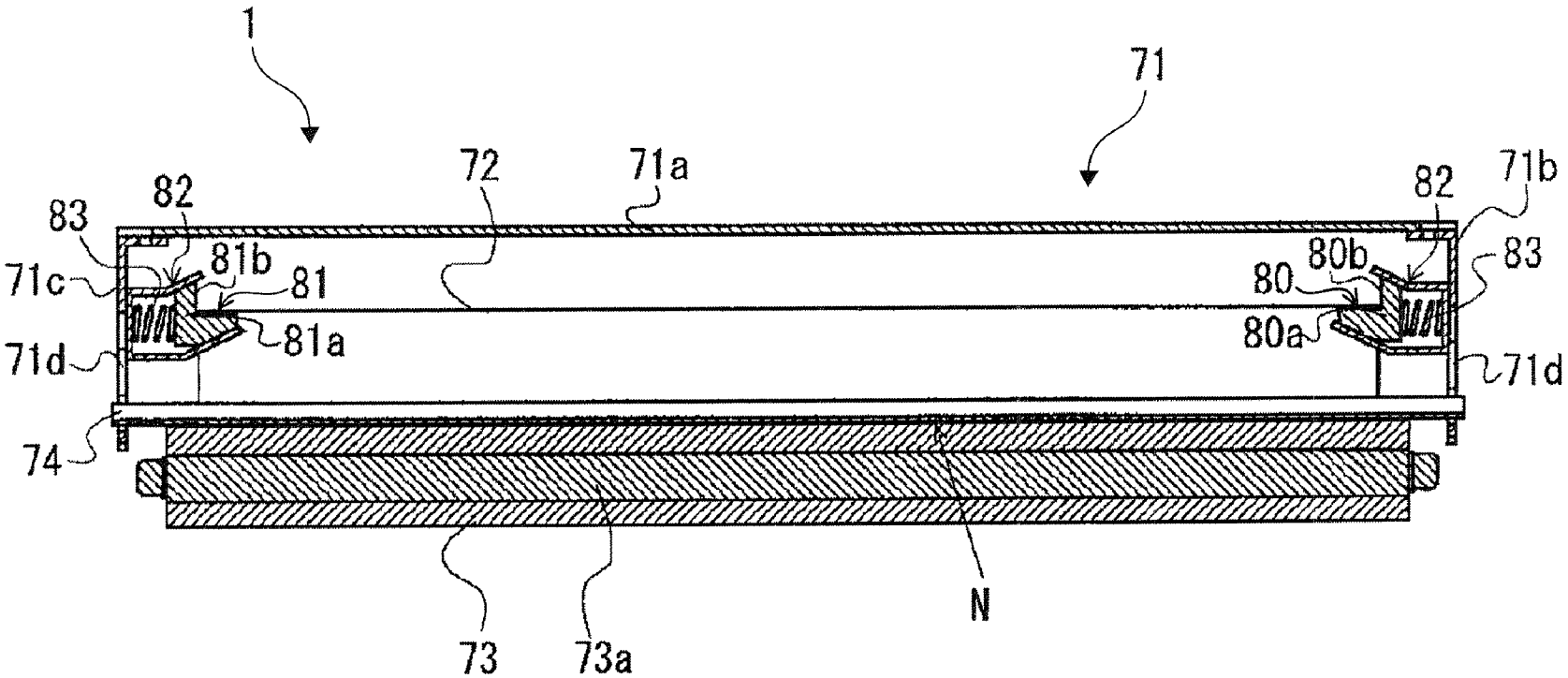
FIG. 3 is a sectional front view of the fixing device.
Figure 4:
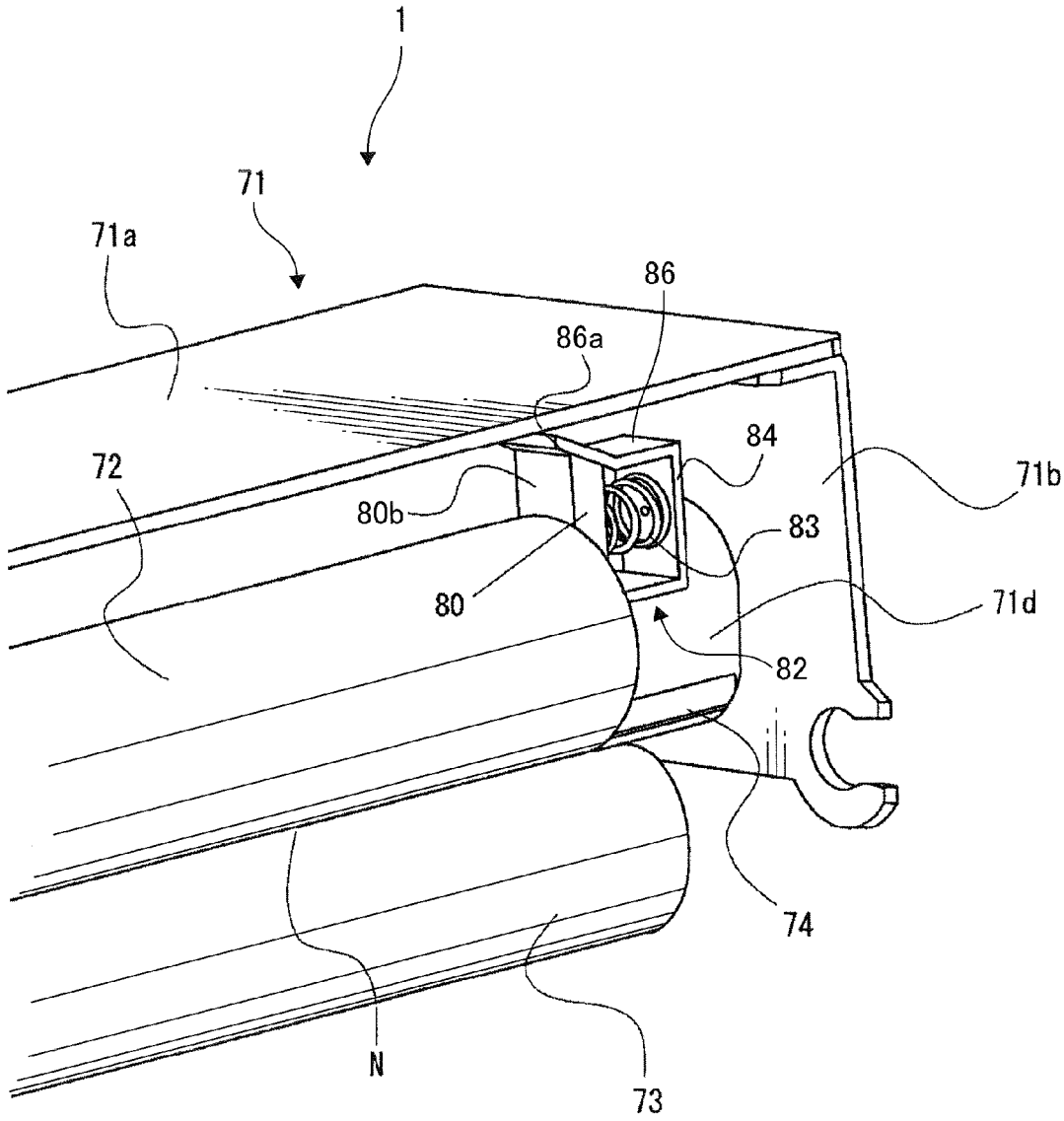
FIG. 4 is a perspective view showing a major portion of the fixing device.

As are shown in FIG. 3 and FIG. 4, the dimension of the pressure member 73 of this embodiment in a direction parallel to the rotation axis direction, that is, the dimension in a direction parallel to the axial direction of the heating member 72 and a direction perpendicular to the sheet transportation direction (a direction perpendicular to the sheet surface of FIG. 2), corresponds to the dimension of A4-sized paper in the portrait direction, and is slightly larger than the dimension of the heating member 72 in the axial direction. This dimension allows the pressure member 73 to apply a pressure to the nip portion N between the self and the heating member 72 across the entire range in a reliable manner to make a fixing pressure stable. It should be noted, however, that the respective dimensions of the pressure member 73 can be set as needed to suit the size of the fixing device 1 and the size of a sheet S used in the image forming apparatus 2.

The pressure receiving member 74 receives a pressure applied to the heating member 72 from the pressure member 73 at the nip portion N between the heating member 72 and the pressure member 73. The pressure receiving member 74 extends in the axial direction of the heating member 72, that is, a direction parallel to the rotation axis of the pressure member 73, and it is provided inside the heating member 72 so as to make contact with the inner surface of a portion of the heating member 72 pressed against the pressure member 73, as is shown in FIG. 2. In other words, the pressure receiving member 74 forms the nip portion N with the pressure member 73 via the heating member 72.

The pressure receiving member 74 possesses strength high enough to receive the pressure. The pressure receiving member 74 can be formed of, for example, a SUS (stainless steel) plate 0.1 mm thick. The thickness, however, is not limited to this specific value, and can be set as needed in response to the strength of the pressure applied to the nip portion N. The pressure receiving member 74 preferably excels not only in a heat capacity, strength, and heat resistance, but also in wear resistance, in order to make sliding contact with the heating member 72. As long as these conditions are satisfied, it can be made of resin. The pressure receiving member 74, formed of an SUS plate having the thickness of the order of 0.1 mm as described above, has a small heat capacity enough to allow a rise of temperature of the heating member 72.

The pressure receiving member 74 is not limited to a specific shape. In this embodiment, side surface of the pressure receiving member 74 is shaped like a capital C that opens at the top. Specifically, the pressure receiving member 74 integrally has a horizontal contact portion 74*a* making contact with the inner surface of the heating member 72, side portions 74*b* standing up in a perpendicular direction at the top and the respective ends of the contact portion 74*a*, and relay portions 74*c* that are interposed in an inclined state between the respective side portions 74*b* and the contact portion 74*a*. This shape allows relative smooth sliding movements of the pressure receiving member 74 and the heating member 72.

The reinforcing member 75 is provided to assist and reinforce the pressure receiving member 74 that receives a pressure from the pressure member 73. In this embodiment, the reinforcing member 75 has a side shape like an inverted capital T as is shown in FIG. 2, and extends in a direction parallel to the axial direction of the heating member 72, being fixed at a position where the reinforcing member 75 abuts on the pressure receiving member 74 from above. The addition of the reinforcing member 75 makes a pressure (fixing pressure) at the nip portion N stable and higher than before, thereby enabling elimination of poor fixing by applying a pressure to a sheet S passing through the nip portion N in a reliable manner.

FIG. 3 is a cross section of the fixing device 1 when viewed in the longitudinal direction of the heating member 72. FIG. 4 is an enlarged perspective view showing a major portion of the fixing device 1, that is, a portion near the end portion of the heating member 72 in the axial direction. For ease of illustration, the reinforcing member 75 and the heat sources 77 are omitted in FIG. 3 and FIG. 4 as well as in FIG. 5.

The fixing device 1 has a housing 71 as are shown in FIG. 3 and FIG. 4. The housing 71 extends along the axial direction of the heating member 72, that is, in a direction parallel to the rotation axis direction of the pressure member 73, holding not only the heating member 72 and the pressure receiving member 74, but also a pair of sliding contact members 80 and 81, holding portions 82, elastic members 83 serving as biasing portions, and so forth, which will be described below.

The housing 71 has a main body wall 71*a* made of a rectangular plate and a pair of side walls 71*b* and 71*c*. Each side wall 71*b* and 71*c* is positioned outside the opposite axial ends of the heating member 72. The main body wall 71*a* is positioned above the heating member 72, that is, positioned at a side of the heating member 72 opposite to the nip portion N, interconnecting the top ends of the side walls 71*b*. Each of the side walls 71*b* and 71*c* has a front shape like an inverted capital L including a main body portion extending in a perpendicular direction and a joint portion extending from the top end of the main body portion inward in the axial direction of the heating member 72. Each joint portion is joined to the bottom surface of the corresponding longitudinal end portion of the main body wall 71*a*.

Both of the side walls 71*b* and 71*c* support the opposite longitudinal ends of the pressure receiving member 74. Specifically, each of the side walls 71*b* and 71*c* is formed with a through-hole (for example, a longitudinal oblong through-hole) 71*d*, through which each of the longitudinal end portions of the pressure receiving member 74 is inserted. Then, Unillustrated fixing members are attached to these longitudinal end portions to firmly fix the pressure receiving member 74 to the housing 71.

Figure 5:
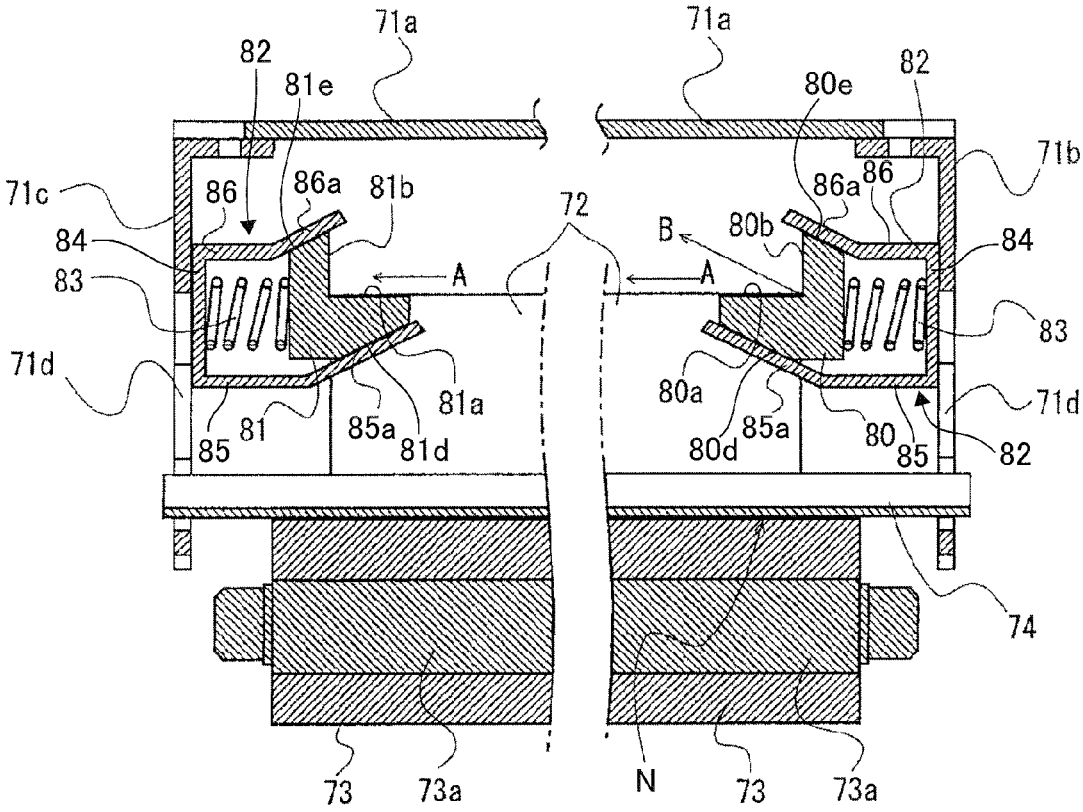
FIG. 5 is a sectional front view showing the major portion of the fixing device.

The sliding contact members 80 and 81 and a supporting mechanism thereof will now be described additionally with reference to FIG. 5. FIG. 5 is an enlarged cross section view showing the structure of the opposite axial end portions of the heating member 72 and the vicinity thereof.

The sliding contact members 80 and 81 are provided so as to make contact with the corresponding axial end portions of the heating member 72 in order to restrict an axial displacement of the heating member 72 from the normal position, and have sliding contact surfaces 80*a* and 81*a* making contact with the inner surfaces of the end portions, respectively. The holding portion 82 and the elastic member 83 are provided to each of the sliding contact members 80 and 81 to form a supporting mechanism for supporting the sliding contact members 80 and 81. The supporting mechanism supports the sliding contact members 80 and 81 in such a manner that the sliding contact surfaces 80*a* and 81*a* of the sliding contact members 80 and 81 come into contact from below with the inner surfaces of the axial end portions of the heating member 72 in portions (the top end portions in the drawing) opposing the pressure receiving member 74. Further, the supporting mechanism displaces the sliding contact members 80 and 81 so that the sliding contact surfaces 80*a* and 81*a* of the sliding contact members 80 and 81 move away from the pressure receiving member 74 as the heating member 72 moves away from either the sliding contact members 80 or 81 along the axial direction.

The sliding contact members 80 and 81 are made of, for example, resin, and each has an almost L-shaped cross section (the cross section shape when viewed in a direction orthogonal to the axial direction of the heating member 72) as is shown in FIG. 3. The sliding contact surfaces 80*a* and 81*a* of the sliding contact members 80 and 81 are horizontal surfaces that can come into contact from below with the inner surfaces of the axial end portions of the heating member 72. Further, the sliding contact member 80 and 81 have restricting surfaces 80*b* and 81*b* at positions adjacent to the sliding contact surfaces 80*a* and 81*a* in the axial direction of the heating member 72, respectively. These restricting surfaces 80*b* and 81*b* stand up in a perpendicular direction from the positions as high as the sliding contact surfaces 80*a* and 81*a* respectively, and are allowed to abut on the axial end surfaces of the heating member 72 in the axial direction. This abutment assures restriction of the axial displacement of the heating member 72.

As is shown in FIG. 5, each of the holding portions 82 has an outside wall 84 outside the corresponding sliding contact member 80 (81) in the axial direction of the heating member 72 and a pair of a first guiding wall 85 and a second guiding wall 86, each of the guiding walls 85 and 86 extending from the outside wall 84 toward the heating member 72. Each of the holding portions 82 in this embodiment is formed of a plate member made of, for example, metal or resin, the plate member having a shape as is bent at an appropriate portion.

The outside wall 84 extends in a perpendicular direction, having a top end and a bottom end, from which the first guiding wall 85 and the second guiding wall 86 extend toward the heating member 72, respectively. The end portion of the first guiding wall 85 on the heating member side forms a first guiding portion 85*a* inclining upward. The top surface of the first guiding portion 85*a* is a guiding surface inclining in the same direction. The sliding contact members 80 and 81 are formed with guided surfaces 80*d* and 81*d* at the bottom end thereof, respectively, each of the guided surfaces 80*d* and 81*d* inclining in a direction parallel to the guiding surface of the first guiding portion 85*a* so as to be able to make sliding contact with the corresponding guiding surface. Likewise, the end portion of the second guiding wall 86 on the heating member side forms a second guiding portion 86*a* inclining upward, and the bottom surface of the second guiding portion 86*a* is a guiding surface inclining in the same direction. The sliding contact members 80 and 81 are formed with guided surfaces 80*e* and 81*e* at the top end thereof, respectively, each of the guided surfaces 80*e* and 81*e* inclining in a direction parallel to the guiding surface of the second guiding portion 86*a* so as to be able to make sliding contact with the corresponding guiding surface.

In other word, the first guiding portions 85*a* of the first guiding walls 85 have the guiding surfaces that make contact with the sliding contact members 80 and 81 from the side (bottom side) closer to the pressure receiving member 74 than the sliding contact members 80 and 81, whereas the second guiding portions 86*a* of the second guiding walls 86 have the guiding surfaces that come into contact with the sliding contact members 80 and 81 from the side (top side) opposite to the pressure receiving member 74. The first guiding walls 85 and the second guiding walls 86 hold the sliding contact members 80 and 81 from above and beneath therebetween, and perform guiding as will be described below.

The respective elastic members 83 are interposed in an elastically compressed state between the respective sliding contact members 80 and 81 and the respective outside walls 84 of the holding members 82 positioned on the outside thereof. Specifically, one ends of the respective elastic members 83 are fixed to the inner surfaces of the outside walls 84, and the other ends are pressed against the outer surfaces (the surfaces on the opposite side to the heating member 72) of the sliding contact members 80 and 81. The elastic members 83 have elastic forces to urge the sliding contact members 80 and 81 inward, that is, in a direction to contact each of the restricting surfaces 80*b* and 81*b* of the sliding contact members 80 and 81 with the corresponding axial end surface of the heating member 72. In other words, the respective elastic members 83 urge the corresponding sliding contact members 80 and 81 to allow the sliding contact members 80 and 81 to axially sandwich the heating member 72 therebetween.

FIG. 3 through FIG. 5 shows a compression coil spring as the elastic members 83, which are not limited to springs, only limited to a member with function of urging the sliding contact members 80 and 81. The outside walls 84 of the holding members 82 may be omitted, while the elastic members 83 being attached directly to the housing 71.

In the fixing device 1, the pressure receiving member 74 and the pressure member 73 sandwich the heating member 72 from above and beneath, and the sliding contact surfaces 80*a* and 81*a* of the both sliding contact members 80 and 81 come into contact with the heating member 72 on the inner surfaces in the portions opposing the pressure receiving member 74. This means that the heating member 72 in the shape of an endless belt is stretched over the respective sliding contact members 80 and 81 and the pressure receiving member 74.

There will be described an operation of the fixing device 1.

The heating member 72, in a shape of an endless belt formed of a film or the like, may lean to one side in the axial direction of the heating member 72 or wobble while it is running. This is attributed to various factors, such as poor parallelism of the axis lines between the heating member 72 and pressure member 73 and thickness of a sheet S passing through the nip portion N. Such leaning or wobbling of the heating member 72 may cause poor fixing, wrinkles of a sheet S, or jamming thereof due to disturbing the transporting direction of the sheet. Further, excessive leaning of the heating member 72 can break the end portion of the heating member 72, thus arising the need for replacement of the heating member 72, particularly in a case where the heating member 72 is in shape of a thin film. In the fixing device 1, however, leaning or wobbling of the heating member 72 that can cause inconveniences as above can be prevented or effectively suppressed as follows.

For example, it is assumed that the heating member 72 is, as is indicated by arrows A in FIG. 5, starting to move to lean toward a side of the sliding contact member 81, which is one of the sides of the heating member 72 in the axial direction. In this instance, the opposite end portion of the heating member 72 on the opposite side undergoes displacement in a direction to move away from the restricting surface 80*b* of the sliding contact member 80 on the opposite side. However, the sliding contact member 80, urged toward the heating member 72 by an elastic force of the elastic member 83, makes displacement in the same direction following the displacement of the sliding contact member 80 so as to maintain the contact of the restricting surface 80*b* with the axial end surface of the heating member 72.

In this time, the sliding contact member 80 is guided by the first guiding portion 85*a* and the second guiding portion 86*a* of the holding unit 82 in a diagonally upward direction, that is, a direction to undergo displacement so as to move away from the pressure receiving member 74 as it comes closer to the heating member 72 (a direction indicated by an arrow B in FIG. 5). Consequently, the sliding contact member 80 is displaced in a direction away from the pressure receiving member 74, that is, in such a direction that the sliding contact surface 80*a* of the sliding contact member 80 lifts up the end portion of the heating member 72 as the heating member 72 is displaced in the direction indicated by the arrows A.

This displacement of the sliding contact surface 80*a* increases a frictional force induced between the sliding contact surface 80*a* and the inner surface of the heating member 72. The increased frictional force functions as a brake that suppresses the displacement of the heating member 72 against a force that causes the heating member 72 to lean in the direction indicated by the arrows A. Further, the displacement of the sliding contact surface 80*a* in a direction to move away from the pressure receiving member 74 also increases a frictional force induced between the inner surface of the heating member 72 and the bottom surface of the pressure receiving member 74. The increased frictional force also functions as a brake that suppresses the displacement of the heating member 72 against a force that causes the heating member 72 to lean in the direction indicated by the arrows A. Even when a relatively large force acts on the heating member 72 in the direction indicated by the arrows A, the above frictional forces can effectively suppress an abrupt movement of the heating member 72 in the same direction.

Further, increases in the both frictional forces make the rotation speed of the heating member 72 at the end portion on the sliding contact member 80 slower than the rotation speed at the opposite end portion. Thus there is produced a difference between the rotation speeds, which contributes to a correction of the position of the heating member 72 in the axial direction. To be more specific, the traveling speed of the heating member 72 on the sliding contact member 81 side, exceeding the traveling speed of the heating member 72 on the sliding contact member 80 side, biases the traveling direction of the heating member 72 toward the sliding contact member 80, thus displacing the heating member 72 back to the original position. This action quickly eliminates its abnormality itself, such as leaning or wobbling of the heating member 72, and thereby contributes to prevention of breakage of the heating member 72.

In other words, even when a large external force in such a direction as to displace the heating member 72 in the axial direction acts on the heating member 72, the supporting mechanism supporting the sliding contact members 80 and 81 thereon displaces the sliding contact members 80 and 81 so as to return the heating member 72 to the normal position, thus preventing or effectively suppressing leaning or wobbling of the heating member 72. This makes it possible to prevent breakage of the end portion of the heating member 72 (in particular the belt end portion) caused when the heating member 72 is biased against the housing or the like of the fixing device 1 with a large force. Accordingly, there is provided the fixing device 1 capable of preventing breaking of the heating member 72 over a long period and achieving a longer life, and the image forming apparatus 2 achieving stable fixing performance and the enhanced convenience for the user and employing the fixing device 1 having a longer life.

There will now be described a structure of a fixing device 1 according to another embodiment of the invention with reference to FIG. 6 through FIG. 8. It should be noted that the embodiment includes a housing 71, a heating member 72, a pressure member 73, a pressure receiving member 74, and a reinforcing member 75, which are the same as the counterparts shown in FIG. 1 through FIG. 5. These are labeled with common reference numerals and description thereof are omitted herein.

Figure 6:
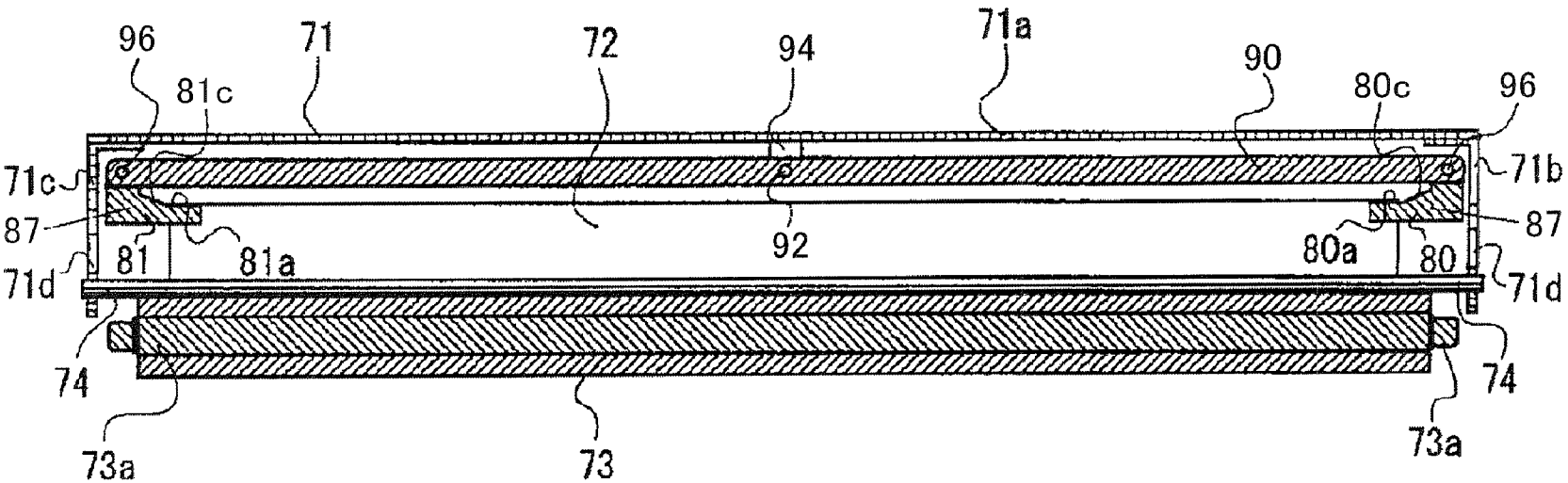
FIG. 6 is a sectional front view of a fixing device according to another embodiment of the invention.
Figure 7:
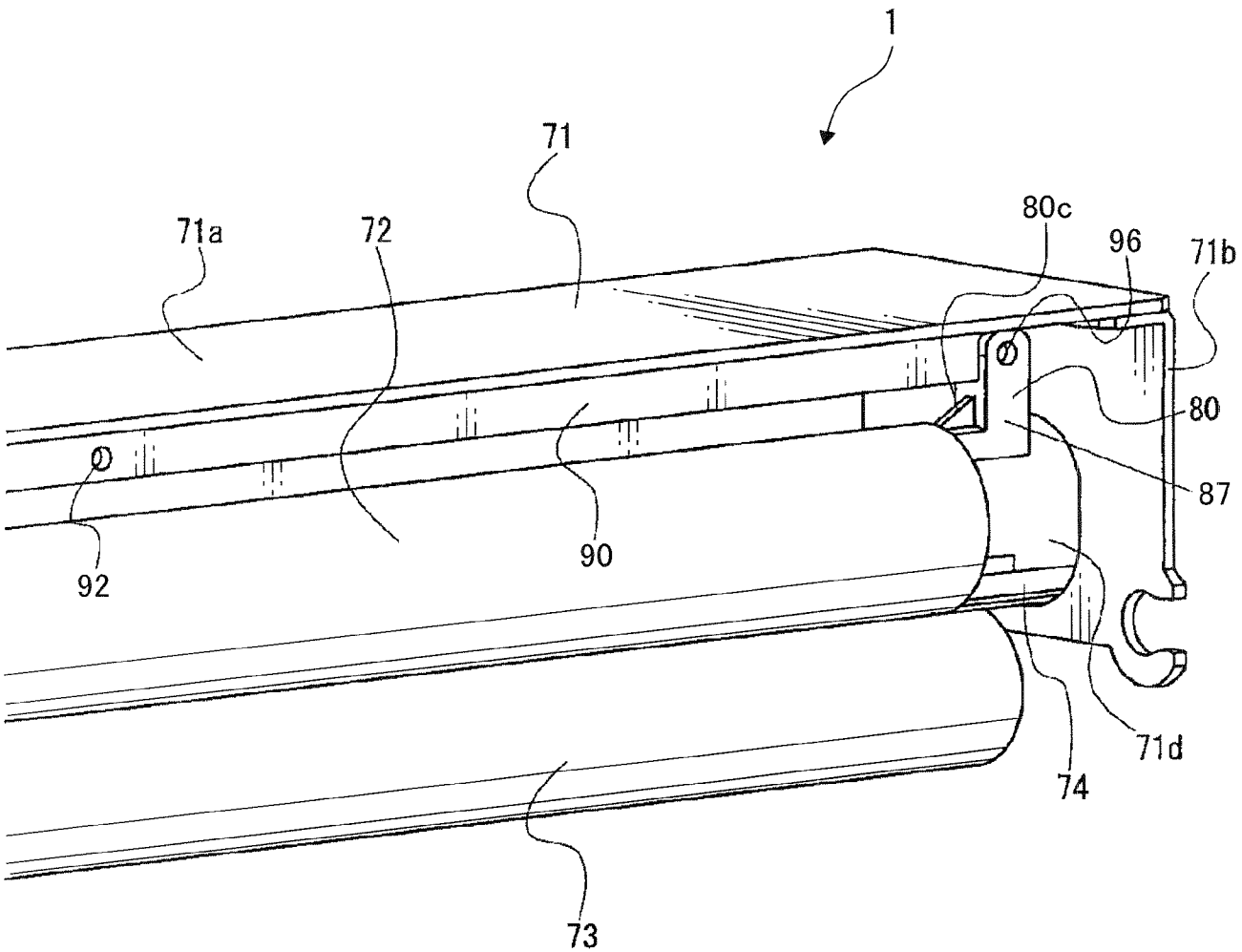
FIG. 7 is a perspective view showing a major portion of the fixing device shown in FIG. 6.
Figure 8:
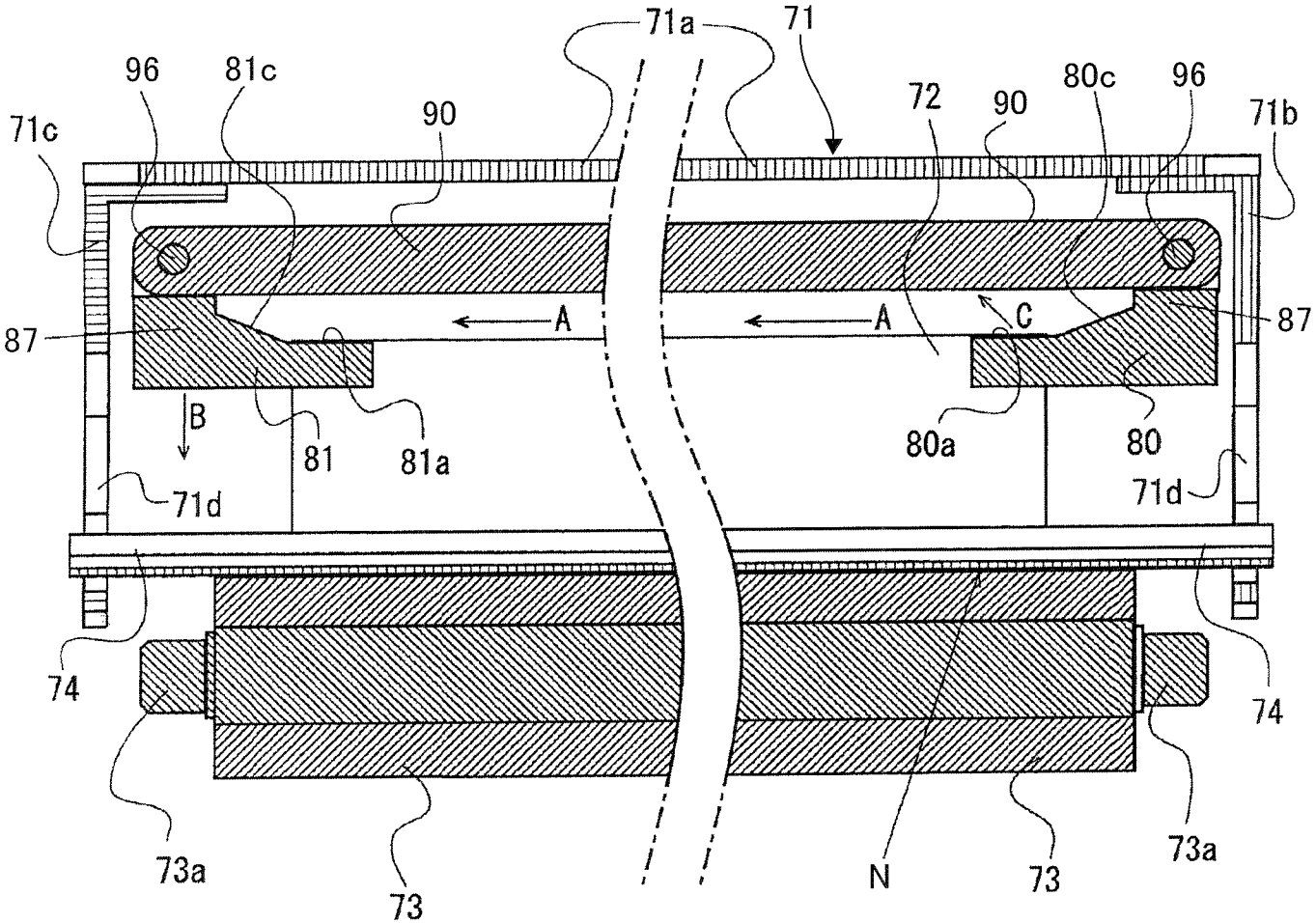
FIG. 8 is a sectional front view showing the major portion of the fixing device shown in FIG. 6.

The fixing device 1 shown in FIG. 6 through FIG. 8 includes sliding contact members 80 and 81 as with the fixing device 1 shown in FIG. 3 through FIG. 5. The specific shape of these sliding contact members 80 and 81 is however different from the shape of the sliding contact members 80 and 81 shown in FIG. 3 through FIG. 5. In addition, there is provided an oscillation member 90 as a supporting mechanism to support the sliding contact members 80 and 81.

As with the fixing device 1 shown in FIG. 3 through FIG. 5, the sliding contact members 80 and 81 are provided to the opposite end portions of the heating member 72 respectively. As is shown in FIG. 8, each of the sliding contact members 80 and 81 has an almost L-shaped cross section (the cross section shape when viewed in a direction orthogonal to the axial direction of the heating member 72), and have horizontal sliding contact surfaces 80*a* and 81*a* respectively. However, the sliding contact members 80 and 81 further have emergency sliding contact surfaces 80*c* and 81*c* respectively, at positions adjacent, to the sliding contact surfaces 80*a* and 81*a* outside the heating member 72 in the axial direction.

The respective emergency sliding contact surfaces 80*c* and 81*c* come into contact with the inner surfaces of the end portions in emergency when the heating member 72 is displaced in the axial direction from the normal position, that is, the position at which the inner surfaces of the axial end portions thereof come into sliding contact with the sliding contact surfaces 80*a* and 81*a*, respectively. Specifically, the emergency sliding contact surfaces 80*c* and 81*c* continue to the adjacent sliding contact surfaces 80*a* and 81*a* respectively, and incline in a direction away from the pressure receiving member 74 (upward in the drawing) as far away from the heating member 72 along the axial direction there of.

The oscillation member 90 is formed, for example, in a rod or plate shape and made of metal, resin, or the like. The oscillation member 90, extending in a direction parallel to the axial direction of the heating member 72, is provided at a position between the heating member 72 and the main body wall 71*a* of the housing 71. The oscillation member 90 has a longitudinally intermediate portion, which is supported on the main body wall 71*a* rotatably about the supporting point 92 around the shaft in a direction orthogonal to the axial direction of the heating member 72. Specifically, there is provided an attachment plate 94 penetrating downward from a bottom surface of the main body wall 71*a* at a longitudinally center portion, the attachment plate 94 supporting the longitudinally intermediate portion of the oscillation member 90 with a pivot orthogonal to the axial direction of the heating member 72.

The sliding contact members 80 and 81 are fixed to the opposite longitudinal end portions of the oscillation member 90 respectively. Oscillation of the oscillation member 90 therefore allows displacement of the respective sliding contact members 80 and 81 in top-bottom direction, that is, displacement in direction to come closer to or move away from the pressure receiving member 74, and further associates the sliding contact members 80 and 81 so as to displace them in directions opposite to each other.

Various changes can be made in a manner for attaching the sliding contact members 80 and 81 to the opposite end portions of the oscillation member 90. The sliding contact members 80 and 81 may be completely fixed to the end portions of the oscillation member 90 with fastening tools or the like, or the sliding contact members 80 and 81 may be attached by fitting protrusion provided on the oscillation member 90 into holes made in the sliding contact members 80 and 81, which allows relative and slight rotation of the sliding contact members 80 and 81 with respect to the oscillation member 90. In the manner shown in FIG. 6 through FIG. 8, the top portions of the sliding contact members 80 and 81 are fixed to the oscillation member 90 by a shaft 96 penetrating through the top portions and the oscillation member 90.

At the opposite end portions of the oscillation member 90, the oscillation member 90 and the respective sliding contact members 80 and 81 form handle portions 87 that open inward. The both sliding contact members 80 and 81 hold the heating member 72 therebetween from the opposite side in the axial direction, the sliding contact surfaces 80*a* and 81*a* of the sliding contact members 80 and 81 making contact with the inner surfaces of the axial end portions of the heating member 72.

The supporting point 92 of the oscillation member 90 is preferably determined so as to equalize distances from the supporting point 92 to the respective sliding contact members 80 and 81. This equalizes amounts of displacement of the sliding contact members 80 and 81 associated with each other.

An operation of the fixing device 1 will now be described.

For example, as is indicated by arrows A in FIG. 8, it is assumed that the heating member 72 is starting to move to lean toward the sliding contact member 81, which is one side in the axial direction. In this instance, the end portion of the heating member 72 on the sliding contact member 81 side moves from the sliding contact surface 81*a*, with which the end portion normally comes into contact, onto the adjacent emergency sliding contact surface 81*c*. Since the emergency sliding contact surface 81*c* inclines in a direction to rise (that is, in a direction away from the pressure receiving member 74) as far away from the sliding contact surface 81*a*, a pressure applied to the emergency sliding contact surface 81*c* from the end portion of the heating member 72 is risen as the end portion of the heating member 72 enters into the emergency sliding contact surface 81*c*. This pressure biases down the sliding contact member 81 as is indicated by an arrow B together with oscillation of the oscillation member 90 (that is, displaces toward the pressure receiving member 74), while the oscillation of the oscillation member 90 lifts up the opposite sliding contact member 80 as is indicated by an arrow C (that is, displaces away from the pressure receiving member 74).

The displacement of the sliding contact member 80 is totally the same as the displacement of the sliding contact member 80 in the fixing device 1 shown in FIG. 3 through FIG. 5 and therefore increases a frictional force induced between the sliding contact surface 80*a* and the heating member 72. The increased frictional force functions as a brake that suppresses displacement of the heating member 72 against a force that causes the heating member 72 to lean in the direction indicated by the arrows A. Further, the displacement of the sliding contact surface 80*a* in a direction to move away from the pressure receiving member 74 increases a frictional force induced between the inner surface of the heating member 72 and the bottom surface of the pressure receiving member 74. This increased frictional force also functions as a brake that suppresses a displacement of the heating member 72 against a force that causes the heating member 72 to lean in the direction indicated by the arrows A. Even when a relatively large force acts on the heating member 72 in the direction indicated by the arrows A, these frictional forces effectively suppress an abrupt movement of the direction of the heating member 72 in this direction.

In short, as with the fixing device 1 shown in FIG. 3 through FIG. 5, increases in the both frictional forces make the rotation speed at the end portion of the heating member 72 on the sliding contact member 80 side slower than the rotation speed at the end portion on the opposite side. A difference between the rotation speeds contributes to a correction of the position of the heating member 72 in the axial direction. Specifically, a difference of the rotation speeds quickly corrects an abnormality itself, such as leaning and wobbling of the heating member 72, and thereby contributes to prevention of breaking of the heating member 72.

That is to say, in the fixing device 1 shown in FIG. 6 through FIG. 8, since leaning and wobbling of the heating member 72 can be prevented or effectively suppressed as in the fixing device 1 shown in FIG. 3 through FIG. 5, breakage of the end portion of the heating member 72 (in particular, the belt end portion) caused when the heating member 72 is pressed against the housing or the like of the fixing device 1 at a large force can be prevented. This makes it possible to provide the fixing device 1 capable of preventing breaking of the heating member 72 over a long period and achieving a longer life, and to provide the image forming apparatus 2 achieving stable fixing performance and the enhanced convenience for the user and employing the fixing device 1 having a longer life.

Furthermore, the emergency sliding contact surfaces 80*c* and 81*c*, which inclines in a direction away from the pressure receiving member 74 as away from the normal sliding contact surfaces 80*a* and 81*a*, can perform an additional effect that the inclination itself of the emergency sliding contact surfaces 80*c* and 81*c* can correct the position of the heating member 72 against an small external force applied to the heating member 72.

It should be appreciated that the invention is not limited to the embodiments described above and can be implemented with various modifications without deviating from the scope of the invention.

Figure 9:
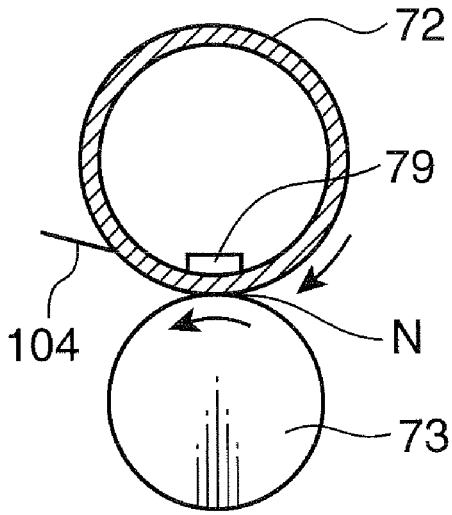
FIG. 9 is a partial sectional front view of a fixing device according to still another embodiment different from those shown in FIG. 3 and FIG. 6.

For example, a heat source 79 as shown in FIG. 9 may be provided at a position corresponding to the pressure receiving member 74 shown in FIG. 2 and other drawings to serve as means for heating the heating member 72 and also as a pressure receiving member. In case, a ceramic heater array is suitable for the heat source 79, for example.

Figure 10:
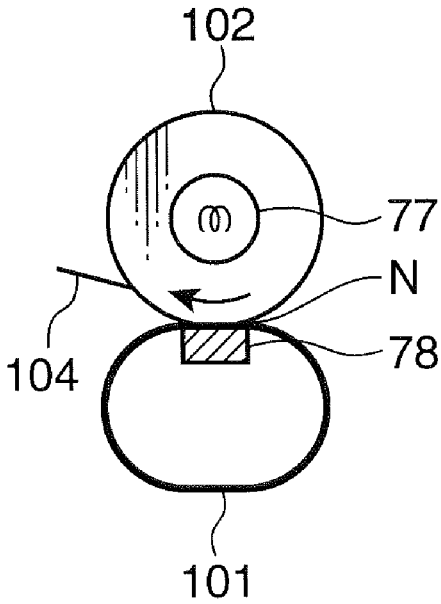
FIG. 10 is a partially sectional front view of a fixing device according to still another embodiment different from those shown in FIG. 3, FIG. 6, and FIG. 9.

In the respective embodiments above, the heating member 72 heated by the heat sources 77 is formed of the first nip member in the shape of an endless belt and the pressure member 73 pressed against the heating member 72 is formed of the second nip member in the shape of a roller pressed against the heating member 72; however, in an embodiment shown in FIG. 10, a second nip member 102 in the shape of a roller forms a heating member heated by the heat source 77 provided in the center portion thereof and a first nip member 101 in the shape of an endless belt forms the pressure member. In this embodiment, a block-shaped pad 78 is provided on the inside of the first nip member 101 as the pressure receiving member. The pad 78 is disposed to the first nip member 101 at a position where the first nip member 101 is pressed against the second nip member 102 to form a nip portion N and can receive a pressure applied from the second nip member 102.

FIG. 9 and FIG. 10 shows a separation plate 104, which is provided at a position in close proximity to the outer peripheral surface of the heating member 72 or the outer peripheral surface of the second nip member 102 downstream of the nip portion N to facilitate separation of a sheet from the corresponding outer peripheral surface.

As has been described, a fixing device according to one aspect of the invention includes: a first nip member in a shape of an endless belt and heated by a heat source; a second nip member that rotates while being pressed against the first nip member so as to drive the first nip member in a direction orthogonal to a central axis of the rotation and form a nip portion between the first nip member and the second member, the nip portion allowing a sheet to enter thereinto; a pressure receiving member provided so as to make contact with an inner surface of the first nip member to receives a pressure applied to the first nip member from the second nip member in the nip portion; a sliding contact member with a sliding contact surface making sliding contact with an axial end portion of the first nip member so as to restrict displacement of the first nip member in the axial direction, which is a direction parallel to a rotation central axis of the second nip member; and a supporting mechanism that supports the sliding contact member.

The supporting mechanism supports the sliding contact member in such a manner that the sliding contact surface of the sliding contact member comes into contact with an inner surface of the axial end portion of the first nip member at a portion opposing the pressure receiving member, and displaces the sliding contact member so that the sliding contact surface of the sliding contact member moves away from the pressure receiving member as the first nip member is displaced in a direction away from the sliding contact member along the axial direction.

The displacement of the sliding contact member increases a frictional force induced between the sliding contact surface and the inner surface of the first nip member and a frictional force induced between the inner surface of the first nip member and the pressure receiving member. These frictional forces act as a brake for preventing or effectively suppressing displacement of the first nip member in the axial direction of the first nip member out of the sliding contact member. Further, the braking action produces a difference between a rotation speed at the end portion of the first nip member in the axial direction on the side where the frictional force has increased and a rotation speed at the end portion on the opposite side. The difference between rotation speeds causes the traveling direction of the first nip member to change in a direction to correct the position of the first nip member in the axial direction.

The action described above can eliminate leaning to the axial direction or wobbling of the first nip member quickly, and thereby prevents breakage or the like of the first nip member resulting from the leaning or wobbling.

In the fixing device of the invention, it may be configured in such a manner that, for example, the first nip member forms a heating member heated by the heat source, and the second nip member forms a pressure member pressed against the heating member or vice versa.

In the invention, it is more preferable that the sliding contact member is provided to each of the opposite axial ends of the first nip member, and that the supporting mechanism supports the both sliding contact members. This achieves effective restriction of abnormal displacement of the first nip member in the axial direction.

In the fixing device of the invention, it is preferable that the fixing device further includes a housing that supports the pressure receiving member, and that the supporting mechanism is attached to the housing. The housing, supporting both of the pressure receiving member and the supporting mechanism, can establish stability of relative positional relation between the pressure receiving member and the both sliding contact members.

Regarding a specific embodiment of the sliding contact member and the supporting mechanism, it is suitable that: the sliding contact member has a restriction portion allowed to abut on an end surface of the first nip member in the axial direction: the supporting mechanism has a holding portion that holds the sliding contact member so as to allow displacement of the sliding contact member in the axial direction of the first nip member, and a urging portion that urges the sliding contact member held by the holding portion in a direction to contact the restriction portion of the sliding contact member with the end surface of the first nip member; and the holding portion has a guiding portion that guides the sliding contact member to displace the sliding contact member so that the sliding contact surface thereof moves away from the pressure receiving member as the sliding contact member comes closer to the first nip member.

In the fixing device, the restriction portion of the sliding contact member is normally pressed against the axial end surface of the first nip member by a urging force of the biasing portion, thereby maintaining the position of the first nip member in the axial direction at the normal position. Meanwhile, when the first nip member moves out of the normal position in the axial direction, the sliding contact member on the side opposite to the sliding contact member is displaced by a urging force acting on the sliding contact member on the opposite side in a direction to follow the displacement of the first nip member, that is, inward. This displacement and guiding of the sliding contact member by the guiding portion of the holding portion displaces the sliding contact surface of the sliding contact member on the opposite side in a direction away from the pressure receiving member. This displacement produces the braking action described above. This device therefore enables prevention or effective suppression of leaning to the axial direction or wobbling of the first nip member by simple structure combining the holding portion that holds and guides the sliding contact member and the urging portion that urges the sliding contact member toward the first nip member.

It is suitable for the guiding portion to have an inclined surface inclining in a direction away from the pressure receiving member as heading for the first nip member along the axial direction of the first nip member to guide the sliding contact member along the inclined surface.

Also, it is preferable that the holding portion has an outside wall positioned outside the sliding contact member in the axial direction of the first nip member, and a guiding wall extending from the outside wall toward the first nip member and having the guiding portion, and that the urging portion has an elastic member attached to the holding portion so as to be interposed between the outside wall and the sliding contact member in an elastically compressed state. This structure, where the holding portion and the urging portion are formed as one unit, can facilitate the attachment of the portions.

In this case, it is more suitable for the holding portion to include, as the guiding wall, a first guiding wall having a first guiding portion that makes contact with the sliding contact member on a side close to the pressure receiving member and a second guiding wall having a second guiding portion that makes contact with the sliding contact member on a side opposite to the pressure receiving member, and to hold the sliding contact member between the first guiding wall and the second guiding wall. The first guiding wall and second guiding wall guide the sliding contact member in an appropriate direction while holding the sliding contact member stably.

In a case where the sliding contact member is provided to each of the axial ends of the first nip member, the supporting mechanism may have the holding portion and the biasing portion for each sliding contact member.

In addition, it is preferable that the fixing device further includes a housing that supports the pressure receiving member, and that the housing has side walls positioned outside each sliding contact member in the axial direction of the first nip member and to support the pressure receiving member and a main body wall interconnecting the side walls, the holding portion and the urging portion being attached to an inner surface of each side wall. In this structure, the housing commonly support both of the pressure receiving member and the holding portion, thereby achieving a stable relative positional relation between the pressure receiving member and the guiding portion of the holding portion. This enables precise determination of the relative position of the sliding contact member with respect to the pressure receiving member.

As another embodiment of the sliding contact member and the supporting mechanism, it is effective that each sliding contact member has an emergency sliding contact surface adjacent to the sliding contact surface outside the first nip member in the axial direction, and has a shape so as to come into contact with an inner surface of the axial end portion of the first nip member when the end portion comes out of the sliding contact surface in the axial direction of the first nip member, and further to receive a pressure higher than a pressure received on the sliding contact surface from the first nip portion, and that the supporting mechanism has an oscillation member oscillatable about a supporting point positioned between the both ends of the first nip member around a shaft in a direction orthogonal to the axial direction, the oscillation member including opposite end portions to which the respective sliding contact members are fixed and oscillating so as to displace one of the sliding contact members in a direction to come closer to the pressure receiving member by a pressure applied to the emergency sliding contact surface from the first nip member and, simultaneously with the displacement, to displace the other sliding contact member in a direction away from the pressure receiving member.

In this fixing device, when the end portion of the first nip member in the axial direction comes out of the sliding contact surface of either one of the sliding contact members onto the emergency sliding contact surface as the first nip member deviates from the normal position in the axial direction, this sliding contact member receives a higher pressure from the first nip member. The oscillation member therefore oscillates to allow displacement of this sliding contact member in a direction to come closer to the pressure receiving member and to displace the other sliding contact member in a direction away from the pressure receiving member simultaneously with the displacement of the counterpart sliding contact member. The displacement of the other sliding contact member produces the braking action described above by the other sliding contact member. Hence, in this device, the simple structure for supporting the both sliding contact members on the oscillation member can prevent or effectively suppress leaning to the axial direction or wobbling of the first nip member.

Herein, it is suitable for the emergency sliding contact surface to incline in a direction away from the pressure receiving member as far away from the first nip member along the axial direction of the first nip member. The emergency sliding contact surface can receive a higher pressure from the axial end portion of the first nip member with an increase of an amount of the axial end portion of the first nip member coming out to the emergency sliding contact surface. In addition, at a stage where a coming out amount of the end portion of the first nip member is relatively small, the inclination itself of the emergency sliding contact surface can perform function of returning the end portion of the first nip member to the normal position.

In the fixing device, it is more preferable that the fixing device further includes a housing that supports the pressure receiving member, and that the oscillation member is supported on the housing oscillably about the supporting point. The housing commonly supports both of the pressure receiving member and the oscillation member, thus achieving a stable relative positional relation between the pressure receiving member and the sliding contact member supported on the oscillation member. This enables precise determination of the relative position of the sliding contact member with respect to the pressure.

More specifically, it is suitable for the housing to have side walls positioned outside respective sliding contact members in the axial direction of the first nip member and supporting the pressure receiving member and a main body wall positioned on a side of the first nip member opposite to the nip portion to interconnect the side walls, and for the oscillation member to be positioned between the first nip member and the main body wall to be oscillably supported on the main body wall. According to this structure, the housing is able to support the oscillation member and the pressure receiving member at their respective suitable positions with the main body wall and the side walls.

Also, it is preferable that distances from the supporting point of the oscillation member to each sliding contact member are equal to each other. This equalizes amounts of displacement of the both sliding contact members in association with oscillations of the oscillation member, which enables uniform restriction of the opposite axial ends of the first nip member.

Another aspect of the invention provides an image forming apparatus that includes the fixing device described above and an image forming portion that mounts toner particles on a sheet to form an image. In the image forming apparatus, the fixing device fixes toner particles mounted on the sheet by the image forming portion, thus forming a high-quality image.

This application is based on patent application Nos. 2007-007690 and 2007-007691 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device for fixing toner particles mounted on a sheet in an image forming apparatus, comprising:

a first nip member in a shape of an endless belt;

a second nip member that rotates about a central axis while being pressed against the first nip member so as to drive the first nip member in a direction orthogonal to the central axis and so as to form a nip portion between the first nip member and the second member, the nip portion allowing a sheet to enter thereinto;

a heat source for heating at least one of the first nip member and the second nip member;

a pressure receiving member that is provided so as to make contact with an inner surface of the first nip member and receives a pressure applied to the first nip member from the second nip member at the nip portion;

a sliding contact member that has a sliding contact surface allowed to make sliding contact with an axial end portion of the first nip member, the sliding contact member being provided to each of the axial ends of the first nip member; and a supporting mechanism that supports the both sliding contact members in such a manner that the sliding contact surface of the sliding contact member makes contact with an inner surface of the axial end portion of the first nip member at a portion opposing the pressure receiving member, and displaces the sliding contact member so that the sliding contact surface of the sliding contact member moves away from the pressure receiving member as the first nip member moves away from the sliding contact member along the axial direction of the first nip member.

2. The fixing device according to claim 1, wherein:

the first nip member forms a heating member heated by the heat source; and the second nip member forms a pressure member pressed against the heating member.

3. The fixing device according to claim 1, further comprising:

a housing that supports the pressure receiving member, wherein the supporting mechanism is attached to the housing.

4. The fixing device according to claim 1, wherein:

each sliding contact member has an emergency sliding contact surface adjacent to the sliding contact surface on an outside of the first nip member in the axial direction, the emergency sliding contact surface having a shape so as to come into contact with an inner surface of the axial end portion of the first nip member to receive a pressure higher than a pressure the sliding contact surface receives from the first nip portion when the axial end portion comes out of the sliding contact surface in the axial direction of the first nip member and to; and the supporting mechanism has an oscillation member oscillate about a supporting point positioned between the both ends of the first nip member around a shaft orthogonal to the axial direction and includes both end portions to which the respective sliding contact members are fixed, and the oscillation member oscillates to allow displacement of one of the sliding contact members in a direction to come closer to the pressure receiving member by a pressure applied to the emergency sliding contact surface from the first nip member and, simultaneously with the displacement, to displace the other sliding contact member in a direction to move away from the pressure receiving member.

5. The fixing device according to claim 4, wherein:

the emergency sliding contact surface inclines in a direction away from the pressure receiving member as far away from the first nip member along the axial direction of the first nip member.

6. The fixing device according to claim 4, further comprising:

a housing that supports the pressure receiving member, wherein the oscillation member is supported on the housing oscillatably about the supporting point.

7. The fixing device according to claim 6, wherein:

the housing has side walls being positioned outside each sliding contact member in the axial direction of the first nip member and supporting the pressure receiving member, and a main body wall positioned on a side of the first nip member opposite to the nip portion to interconnect the side walls; and the oscillation member is oscillatably supported on the main body wall between the first nip member and the main body wall.

8. The fixing device according to claim 4, wherein:

distances from the supporting point of the oscillation member to respective sliding contact members are equal to each other.

9. A fixing device for fixing toner particles mounted on a sheet in an image forming apparatus, comprising:

a first nip member in a shape of an endless belt;

a second nip member that rotates about a central axis while being pressed against the first nip member so as to drive the first nip member in a direction orthogonal to the central axis and so as to form a nip portion between the first nip member and the second member, the nip portion allowing a sheet to enter thereinto;

a heat source for heating at least one of the first nip member and the second nip member;

a pressure receiving member that is provided so as to make contact with an inner surface of the first nip member and receives a pressure applied to the first nip member from the second nip member at the nip portion;

a sliding contact member that has a sliding contact surface allowed to make sliding contact with an axial end portion of the first nip member, the sliding contact member having a restriction portion allowed to abut on an axial end surface of the first nip member; and a supporting mechanism that supports the sliding contact member in such a manner that the sliding contact surface of the sliding contact member makes contact with an inner surface of the axial end portion of the first nip member at a portion opposing the pressure receiving member, and displaces the sliding contact member so that the sliding contact surface of the sliding contact member moves away from the pressure receiving member as the first nip member moves away from the sliding contact member along the axial direction of the first nip member wherein the supporting mechanism has:

a holding portion that holds the sliding contact member allowing displacement of the sliding contact member in the axial direction of the first nip member; and an urging portion that urges the sliding contact member held by the holding portion in a direction to cause the restriction portion of the sliding contact member to abut on the end surface of the first nip member, and wherein the holding portion has a guiding portion that guides the sliding contact member so as to displace the sliding contact member so that the sliding contact surface thereof moves away from the pressure receiving member as the sliding contact member comes closer to the first nip member.

10. The fixing device according to claim 9, wherein:

the guiding portion has an inclined surface that inclines in a direction away from the pressure receiving member as heading for the first nip member along the axial direction of the first nip member, and guides the sliding contact member along the inclined surface.

11. The fixing device according to claim 9, wherein:

the holding portion has an outside wall positioned outside the sliding contact member in the axial direction of the first nip member, and a guiding wall extending from the outside wall toward the first nip member and having the guiding portion; and the urging portion has an elastic member attached to the holding portion so as to be interposed between the outside wall and the sliding contact member in an elastically compressed state.

12. The fixing device according to claim 11, wherein:

the holding portion includes, as the guiding wall, a first guiding wall having a first guiding portion making contact with the sliding contact member on a side close to the pressure receiving member and a second guiding wall having a second guiding portion making contact with the sliding contact member on a side opposite to the pressure receiving member, and holds the sliding contact member between the first guiding wall and the second guiding wall.

13. The fixing device according to claim 9, wherein:

the sliding contact member is provided to each of both axial ends of the first nip member; and the supporting mechanism has the holding portion and the urging portion for each sliding contact member.

14. The fixing device according to claim 13, further comprising:

a housing that supports the pressure receiving member, wherein:

the housing has side walls being positioned outside each sliding contact member in the axial direction of the first nip member and supporting the pressure receiving member, and a main body wall interconnecting the side walls; and the holding portion and the urging portion are attached to an inner surface of each side wall.

15. An image forming apparatus for forming an image on a sheet, comprising:

an image forming portion that mounts toner particles on the sheet to form the image; and the fixing device that fixes the toner particles mounted on the sheet;

wherein the fixing device comprises:

a first nip member in a shape of an endless belt;

a second nip member that rotates about a central axis while being pressed against the first nip member so as to drive the first nip member in a direction orthogonal to the central axis and so as to form a nip portion between the first nip member and the second member, the nip portion allowing a sheet to enter thereinto;

a heat source for heating at least one of the first nip member and the second nip member;

a pressure receiving member that is provided so as to make contact with an inner surface of the first nip member and receives a pressure applied to the first nip member from the second nip member at the nip portion;

a sliding contact member that has a sliding contact surface allowed to make sliding contact with an axial end portion of the first nip member, the sliding contact member having a restriction portion allowed to abut on an axial end surface of the first nip member; and a supporting mechanism that supports the sliding contact member in such a manner that the sliding contact surface of the sliding contact member makes contact with an inner surface of the axial end portion of the first nip member at a portion opposing the pressure receiving member, and displaces the sliding contact member so that the sliding contact surface of the sliding contact member moves away from the pressure receiving member as the first nip member moves away from the sliding contact member along the axial direction of the first nip member, wherein the supporting mechanism has:

a holding portion that holds the sliding contact member allowing displacement of the sliding contact member in the axial direction of the first nip member; and a urging portion that urges the sliding contact member held by the holding portion in a direction to cause the restriction portion of the sliding contact member to abut on the end surface of the first nip member, and wherein the holding portion has a guiding portion that guides the sliding contact member so as to displace the sliding contact member so that the sliding contact surface thereof moves away from the pressure receiving member as the sliding contact member comes closer to the first nip member.

16. An image forming apparatus for forming an image on a sheet, comprising:

an image forming portion that mounts toner particles on the sheet to form the image; and the fixing device that fixes the toner particles mounted on the sheet;

wherein the fixing device comprises:

a first nip member in a shape of an endless belt;

a second nip member that rotates about a central axis while being pressed against the first nip member so as to drive the first nip member in a direction orthogonal to the central axis and so as to form a nip portion between the first nip member and the second member, the nip portion allowing a sheet to enter thereinto;

a heat source for heating at least one of the first nip member and the second nip member;

a pressure receiving member that is provided so as to make contact with an inner surface of the first nip member and receives a pressure applied to the first nip member from the second nip member at the nip portion;

a sliding contact member that has a sliding contact surface allowed to make sliding contact with an axial end portion of the first nip member a supporting mechanism that supports the sliding contact member in such a manner that the sliding contact surface of the sliding contact member makes contact with an inner surface of the axial end portion of the first nip member at a portion opposing the pressure receiving member, and displaces the sliding contact member so that the sliding contact surface of the sliding contact member moves away from the pressure receiving member as the first nip member moves away from the sliding contact member along the axial direction of the first nip member, each sliding contact member having an emergency sliding contact surface adjacent to the sliding contact surface on an outside of the first nip member in the axial direction, the emergency sliding contact surface having a shape so as to come into contact with an inner surface of the axial end portion of the first nip member to receive a pressure higher than a pressure the sliding contact surface receives from the first nip portion when the axial end portion comes out of the sliding contact surface in the axial direction of the first nip member and to; and the supporting mechanism has an oscillation member oscillate about a supporting point positioned between the both ends of the first nip member around a shaft orthogonal to the axial direction and includes both end portions to which the respective sliding contact members are fixed, and the oscillation member oscillates to allow displacement of one of the sliding contact members in a direction to come closer to the pressure receiving member by a pressure applied to the emergency sliding contact surface from the first nip member and, simultaneously with the displacement, to displace the other sliding contact member in a direction to move away from the pressure receiving member.

* * * * *